US008545148B2

(12) United States Patent
Wanek-Pusset et al.

(10) Patent No.: US 8,545,148 B2
(45) Date of Patent: Oct. 1, 2013

(54) CONTAINER AND CONTAINER WAGON

(76) Inventors: Peter Wanek-Pusset, Kapfenberg (AT); Bernhard Grentner, Breitenau (AT)

( * ) Notice: Subject to any disclaimer, the term of this patent is extended or adjusted under 35 U.S.C. 154(b) by 0 days.

(21) Appl. No.: 13/297,868

(22) Filed: Nov. 16, 2011

(65) Prior Publication Data

US 2012/0128442 A1 May 24, 2012

(30) Foreign Application Priority Data

Nov. 16, 2010 (AT) ..... A 1892/2010

(51) Int. Cl.
*B60P 3/00* (2006.01)
*B65D 88/02* (2006.01)

(52) U.S. Cl.
USPC ..... 410/68

(58) Field of Classification Search
USPC ..... 410/68; 298/24
See application file for complete search history.

(56) References Cited

U.S. PATENT DOCUMENTS

| | | | | |
|---|---|---|---|---|
| 3,175,606 | A * | 3/1965 | Talmey et al. | 165/41 |
| 3,595,508 | A * | 7/1971 | Knight | 410/46 |
| 3,800,712 | A * | 4/1974 | Krug, Jr. | 410/54 |
| 3,971,491 | A * | 7/1976 | Mowatt-Larssen et al. | 220/647 |
| 4,138,163 | A * | 2/1979 | Calvert et al. | 406/129 |
| 4,430,032 | A * | 2/1984 | Morgan | 410/68 |
| 4,571,143 | A * | 2/1986 | Hellerich | 414/523 |
| 5,529,222 | A * | 6/1996 | Toth et al. | 222/181.3 |
| 5,688,086 | A * | 11/1997 | Menzemer et al. | 410/68 |
| 6,401,983 | B1 | 6/2002 | McDonald et al. | |
| 7,481,384 | B2 * | 1/2009 | Truan et al. | 239/661 |
| 7,540,436 | B2 * | 6/2009 | Truan et al. | 239/661 |

FOREIGN PATENT DOCUMENTS

| | | |
|---|---|---|
| CN | 201390486 | 1/2010 |
| DE | 229 095 | 10/1985 |
| EP | 1 052 194 | 11/2000 |
| FR | 2 558 807 | 8/1985 |

* cited by examiner

*Primary Examiner* — H Gutman
(74) *Attorney, Agent, or Firm* — Ostrolenk Faber LLP

(57) ABSTRACT

A container for transporting bulk material in combined (multimode) traffic, in particular on railways, roadways and ships, with a rectangular outer structure having standard dimensions and an open steel frame construction, which carries at least one container (hopper) for holding the bulk material. The hopper tapers like a funnel and can be emptied via at least one floor flap. The steel frame structure exhibits two lower longitudinal members, which are free of connecting cross members, so that inside the steel frame structure and beneath the container for holding the bulk material, a downwardly completely open and in the longitudinal direction of the steel frame structure continuously extending open space is available.

17 Claims, 8 Drawing Sheets

CONTAINER AND CONTAINER WAGON

BACKGROUND

Described herein is a container for transporting bulk material in combined (multimode) traffic, in particular on railways, roadways and ships, with a rectangular outer structure having standard dimensions and an open steel frame construction, which carries at least one hopper for holding the bulk material that tapers like a funnel and can be emptied via at least one floor flap. Also described is a container wagon.

Special self-emptying funnel wagons are usually used for bulk material transport operations with gravity-assisted unloading in rail traffic. The lower region of the latter exhibits respective sliders on the left and right, which when closed each seal one outlet opening, and can be opened by means of a control lever, which can be operated from a control platform located on the wagon. The known self-emptying funnel wagons are exclusively usable in rail traffic, and hence do not permit any use in combined traffic. Depending on the cargo, varying requirements are also placed on the discharge chutes; for example, there are types of cargo that do not allow unloading via the usual discharge chutes, since they are too coarse-grained, e.g., in cases involving excavated material from construction sites. Since the known wagons are special wagons, they most frequently offer poor availability, in particular when a higher number of wagons are needed.

For example, a container of the kind mentioned at the outset is known from U.S. Pat. No. 6,401,983 B1. The container suitable for transporting bulk material exhibits several containers that taper like funnels and have floor flaps, which are incorporated in an open steel frame structure. Known from DD 229 095 A1 is a container with a standard design, which exhibits one or more bulk material inserts that are sealed by floor flaps. These floor flaps are provided with an actuating mechanism, so that as the container is being placed on a frame with a clamping bolt, the floor flaps automatically open, and can close again while hoisting.

SUMMARY

An important object of the invention is to provide a container of the kind mentioned at the outset, which is especially well suited for the transport of bulk material, in particular heavy bulk material, such as gravel or ore, in combined traffic, in particular on railways and roadways, and can be reloaded in an efficient manner and unloaded in a variety of ways.

This object can be achieved by a steel frame structure that exhibits two lower longitudinal members, which are free of connecting cross members, so that inside the steel frame structure and beneath the hopper for holding the bulk material a downwardly completely to open and in the longitudinal direction of the steel frame structure continuously extending open space is available.

This open steel frame structure that leaves an open space beneath the container enables an optimal handling of the container in combined traffic, and offers a variety of ways in which to efficiently reload and unload the container.

In particular, the outer structure can be designed in such a way that the contact area of the container is formed primarily or exclusively by the two lower longitudinal members of the steel frame structure. This yields the longitudinally continuous, open space in the lower region of the hopper between the longitudinal members, which expands the options available for unloading the container according to the invention in myriad ways, as will be described below.

The steel frame structure can be readily designed in such a way as to enable standard transport of the container on railway vehicles, in particular container wagons, and also on trucks and the like, or standard reloading with known equipment, e.g., reach stackers and the like. All that need be done to this end is to provide corresponding fittings on the steel frame structure, in particular on its corners.

The containers can also be reloaded and unloaded with forklifts. For example, it is provided for this purpose that the lower longitudinal members of the steel frame structure are provided in pairs with openings for threading the forks of a forklift. Therefore, the container can be rotated for purposes of unloading by means of known forklifts, which are provided with lift frames having turning attachments.

The steel frame structure can be further designed in such a way as to ensure the stability and rigidity necessary for transporting and handling heavy bulk materials. In particular, the face of the steel frame structure exhibits a respective pair of corner supports, which are each joined with a cross member spaced a distance apart from the lower longitudinal members. In addition, the steel frame structure encompasses support elements, which support the hopper against the lower longitudinal members and the mentioned cross members.

In an advantageous embodiment, the outlet opening of the hopper carried by the steel frame structure can be sealed with two floor flaps, which can be operated from a platform situated in the steel frame structure and carried by the latter. Therefore, the open steel frame structure also has the advantage that the rectangular construct can incorporate both a platform for operating personnel and the device for opening and closing the floor flaps.

Also described is a container wagon for containers designed as disclosed herein. Container wagons usually exhibit wagon frames arranged on rail mountings for accommodating the containers. Container wagons designed according to this disclosure exhibit a retention opening for inserting a discharge chute, the fill opening of which is tailored to the outlet opening of the hopper. Therefore, the container wagon ensures a comfortable and expedient unloading of bulk material from the container. When the container is emptied, the bulk material falls to the floor or into a deep bunker via the discharge chute. For this reason, container wagons designed in this way are used in particular as "unloading wagons" for containers loaded with bulk material. In an especially advantageous embodiment of the discharge chute, the latter exhibits a discharge funnel and at least one discharge slide, but in particular two discharge slides. If two discharge slides are provided, it is advantageous to pivot a flap to or in the discharge chute, which can be operated outside the discharge chute and moved into positions in which one or the other discharge slide is sealed.

Another embodiment of a container wagon having a wagon frame for accommodating the containers that is arranged on rail mountings and especially suited for unloading the disclosed containers is characterized by the fact that at least one conveyor belt is mounted on the wagon frame, running over the entire length of the wagon, wherein connecting elements for positioning the containers are situated on the wagon frame. If several such container wagons are coupled together, it is possible to transport bulk material unloaded onto the conveyor belts from one wagon to the next, for example to supply ballasts from any number of containers desired to a machine for track construction. The "transfer" of bulk material from one container wagon to the next can be easily accomplished by having at least one end of the respective conveyor belt exhibit an upward and downward folding conveyor belt section protruding over the container wagon.

BRIEF DESCRIPTION OF THE DRAWINGS

Additional features, advantages and details will now be described in greater detail based on the drawing, which diagrammatically depicts several exemplary embodiments. Shown on.

DETAILED DESCRIPTION

Figure 1:
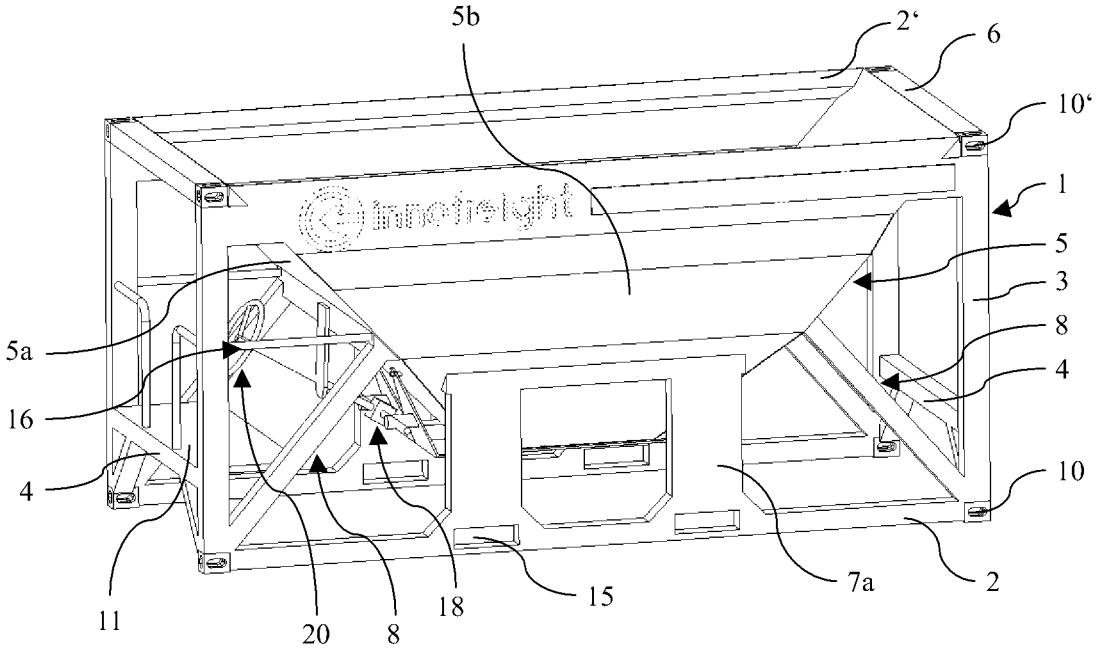
FIG. 1 to FIG. 4 are different views of a container.

The container shown on FIG. 1 to 4 is a bulk material container, which is provided in particular for transporting heavy bulk material, such as gravel or ore. As the support element, the container exhibits a rectangular steel frame structure 1 having standard dimensions, which in the embodiment depicted essentially exhibits two upper longitudinal members 2' and two lower longitudinal members 2 on the longitudinal sides, and a respective two corner supports 3 on the faces, which are interconnected at the upper corners by way of transverse members 6. The steel frame structure 1 essentially forms a rectangle, for example one having a width of 2.55 m and a length of 20 ft. The upper rectangle corners of the steel frame structure 1 are provided with corner fittings 10', which make it possible to reload the container with a reach stacker, while corner fittings 10 on the lower rectangle corners make it possible to secure the container using standard-design couplings on trucks and container wagons in railway traffic. A respective cross member 4 is provided on the two faces of the steel frame structure 1 spaced a distance apart from the lower cross members 2 between the corner supports 3 running in pairs, and connected with the lower corners of the steel frame structure 1 by means of braces 4*a* inclined relative to the perpendicular. A platform 11 is situated on the one face of the container at the level of the cross member 4.

Figure 4:
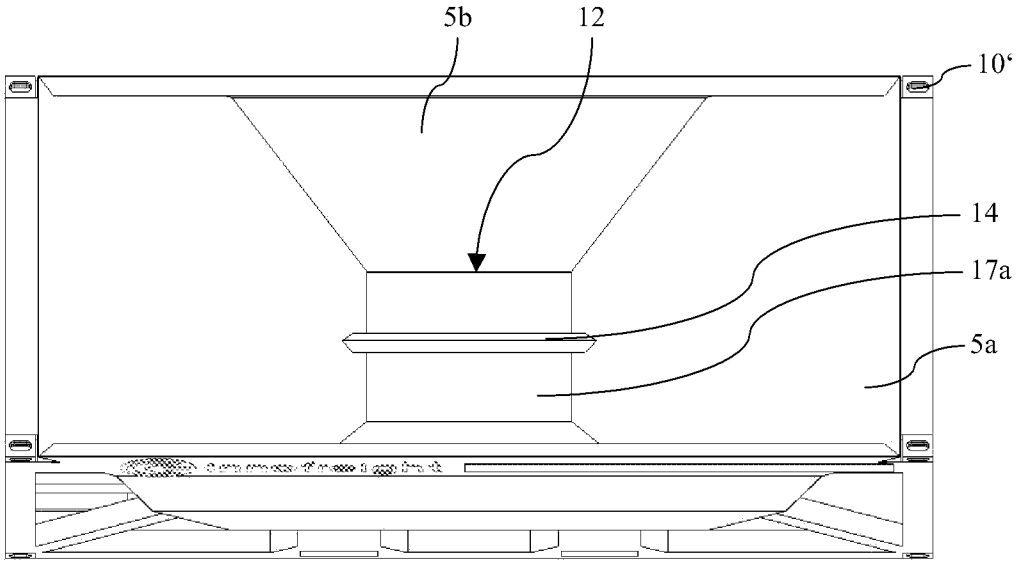
Figure 5:
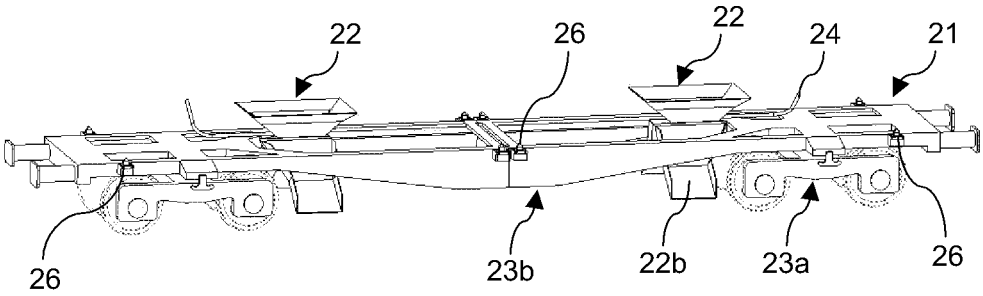
FIG. 5 to FIG. 9 are views of a container wagon with discharge chutes for two containers.
Figure 6:
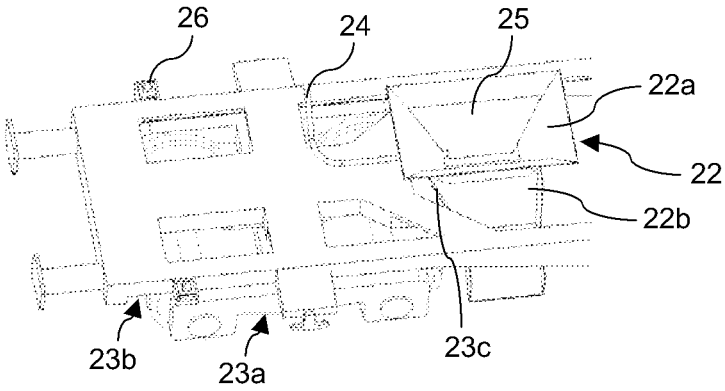

A hopper 5 designed like a funnel is inserted into the steel frame structure 1 and bonded thereto, in particular welded thereto, wherein the upper container opening is bordered by the upper longitudinal members 2' and the cross members 6. The hopper 5 exhibits two front walls 5*a* and two longitudinal walls 5*b*, which each are composed of several wall elements. On the floor of the hopper 5, the walls 5*a*, 5*b* border a rectangular outlet opening 12, which is significantly smaller than the upper container opening. For example, the opening 12 exhibits a width of 60 cm and length of 130 cm, and is centrally divided in the longitudinal direction of the container into two opening halves 12*a* by means of a separating element 14 (FIG. 4). The longitudinal walls 5*b* are each joined by means of a perpendicularly running support element 7 with one of the lower longitudinal members 2, and thereby supported against the steel frame structure. Each support element 7 exhibits a pair of perpendicularly situated support elements 7*a*, which each exhibit a connecting or transition segment to the longitudinal members 2, wherein each transition section incorporates a rectangular opening 15 for accommodating a fork of a forklift. As a consequence, the two rectangular openings 15 are spaced mutually apart by a distance corresponding to the reciprocal spacing between the forks of the forklift for each lower longitudinal member 2. Viewed in the transverse direction of the container, the openings 15 of the one longitudinal member 2 are flush with the openings 15 of the second lower longitudinal member 2, so that the forks of the forklift can be threaded into the openings 15 of the two lower longitudinal members 2 for receiving the container. Additional U-shaped support elements 8 externally join the front walls 5*a* with the lower corners of the steel frame structure 1, and also support the hopper 5. A railing 16, for example made out of tubular steel, is provided in the area of the platform 11, and connected, in particular welded, to the corner supports 3, the platform 11 (leaving an access point), and the support element 8.

Figure 2:
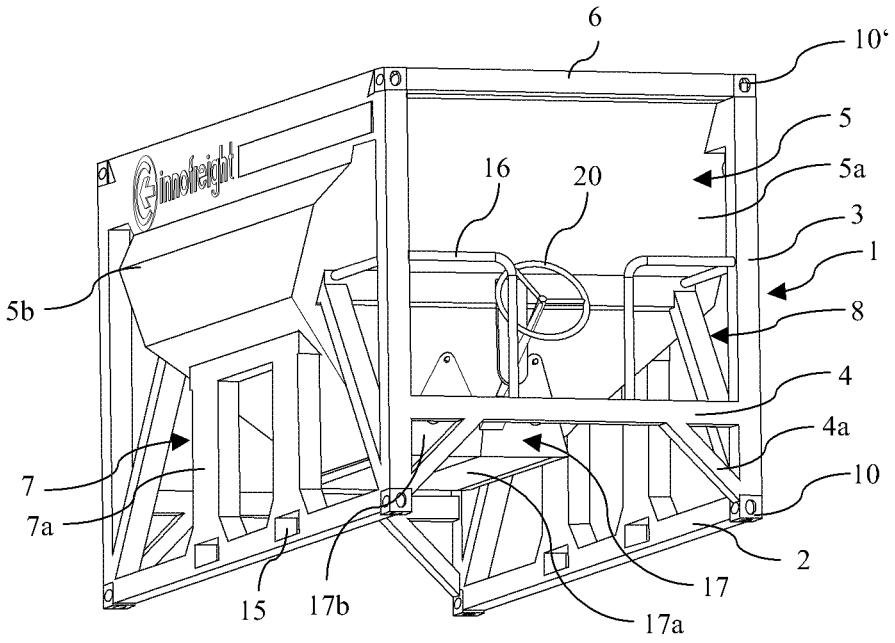

The opening halves 12*a* of the outlet opening 12 can be sealed with one flap 17 each, which as shown in particular on FIG. 2, each exhibit a preferably flat floor 17*a* and two side parts 17*b*, by means of which each flap 17 is rotatably hinged or mounted to the front walls 5*a* of the hopper 5. The side parts 17*b* of the two flaps 17 located by the platform 11 are joined together by way of a spindle drive 18, which can be actuated using a hand wheel 20, so that the flaps 17 can be moved to their open position by turning the hand wheel 20 in one of the rotational directions, and moved back to their closed position again by turning the hand wheel 20 in the other direction. The hand wheel 20 is situated in such a way that an operator standing on the platform 11 can comfortably open and close the two flaps 17. Other actuating devices for opening and closing the two flaps 17 can be provided in place of the depicted and described spindle drive 18, in particular those that hydraulically, pneumatically, or electrically initiate the opening and closing process.

Figure 3:
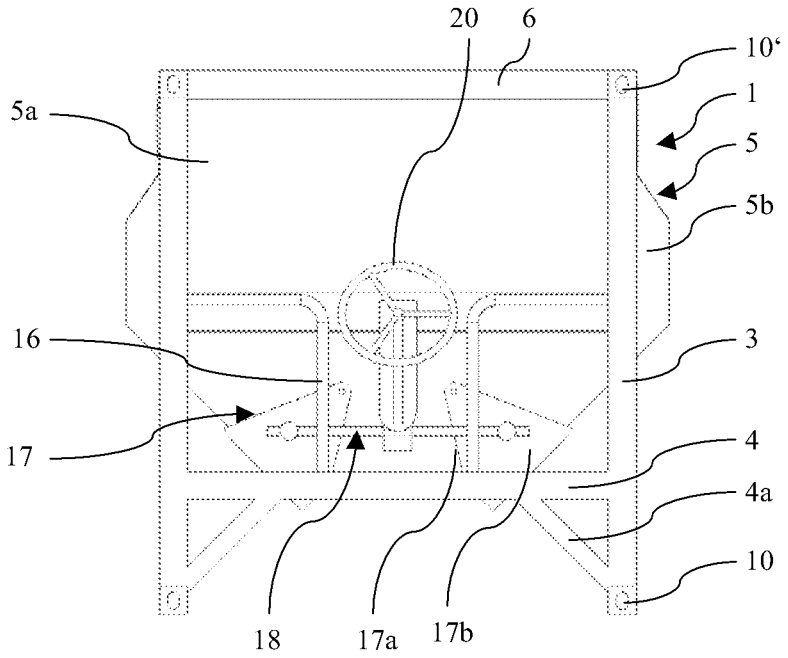

As shown on FIG. 1 to FIG. 3, the outlet opening 12 is located above the contact area of the container defined by the two lower longitudinal members 2. In particular, the outlet opening 12 is located at least at the level of the cross members 4 or platform 11. This creates a continuous, tunnel-like open space above the two longitudinal members 2 in the longitudinal direction of the container, for example which is about 60 cm high.

There are a varied and variable number of ways in which to transport, unload and reload a container designed according to the invention. For example, in rail transport, use can be made of conventional 60 ft container wagons. If containers designed according to the invention exhibit a length of 20 ft, they can also be transported on 40 ft container wagons. In particular the techniques described below are tailored to the container designed according to the invention, and can be used for unloading the containers or unloading the bulk material.

Figure 7:
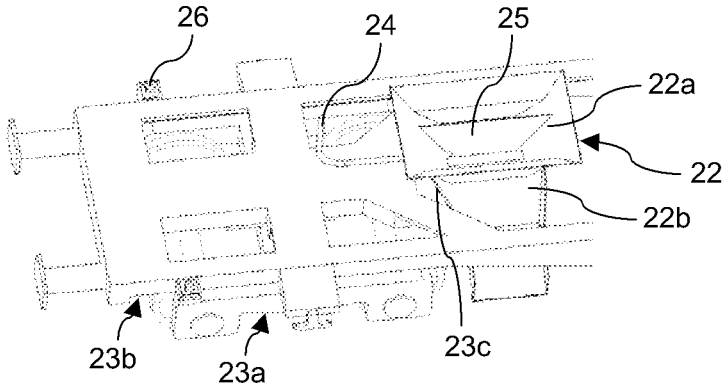
Figure 8:
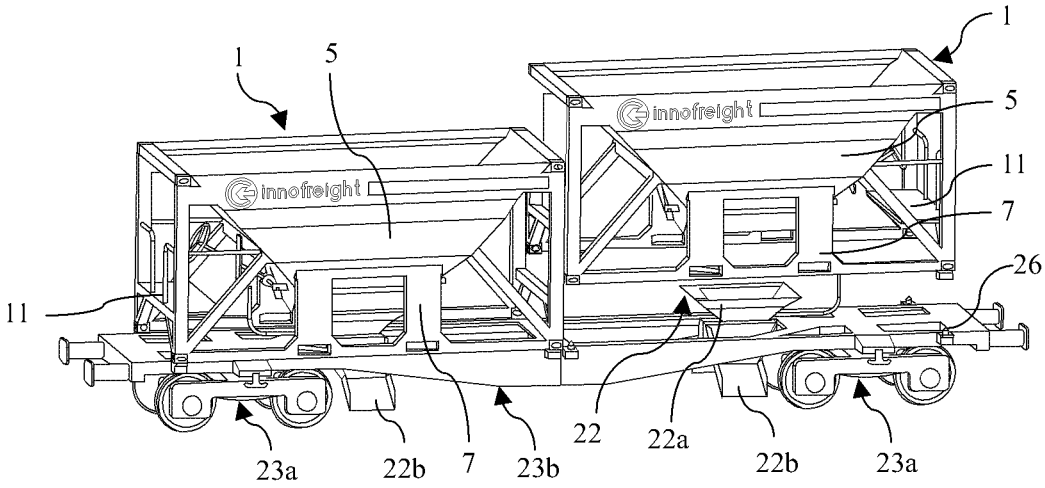
Figure 9:
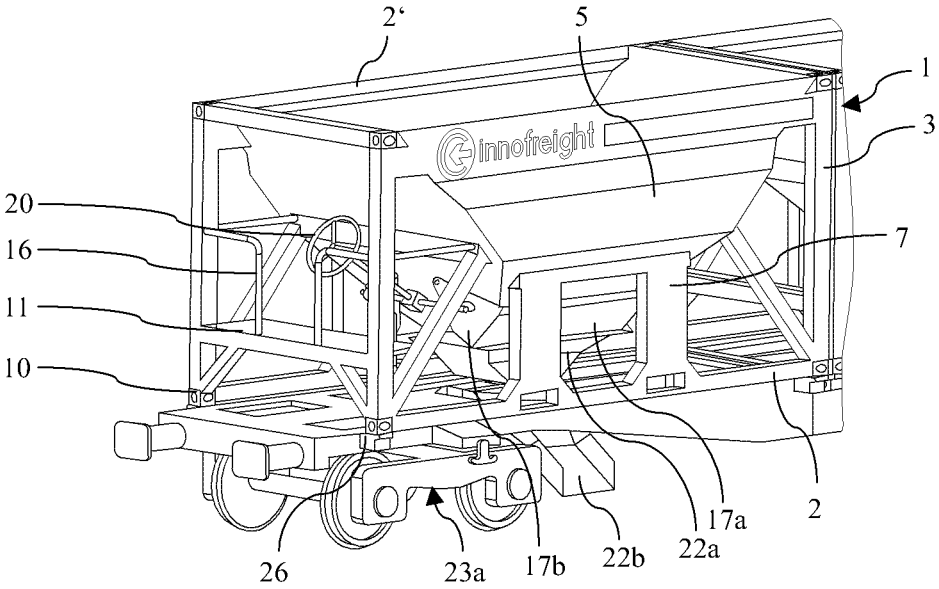

FIG. 5 to FIG. 9 show one of these options. The container wagon 21 depicted on these figures exhibits a wagon frame 23*b* positioned on rail mountings 23*a*. Connecting elements 26 for the corner fittings 10 of the containers are located on the wagon frame 23*b*, spaced correspondingly apart from each other. Provided in the free installation space between the two rail mountings 23*a* are retention openings 23*c*, in which a respective discharge chute 22 can be placed or suspended from above. Each discharge chute 22 exhibits a discharge funnel 22*a*, whose upper opening is adjusted to the outlet opening 12 of the container. Two discharge slides 22*b* are positioned on the lower side of the discharge funnel 22*a*, in such a way that the bulk material can optionally be unloaded to the right or left or to the right and left in equal measure, relative to the longitudinal direction of the container wagon 21. Which slide(s) 22*b* is/are used to discharge the bulk material is determined by means of a rotary slide 24 that actuates a flap 25. FIG. 7 shows the flap 25 in its perpendicular position, which releases both slides 22*b*. Depending on the position of the rotary slide 24, the flap 25 can seal off access to one or the other slide 22*b*. For example, the rotary slide 24 can actuate the flap 25 by means of a spindle drive. When emptying the container, the cargo falls onto the floor or into a deep bunker by way of the slides 22*b*. FIG. 8 shows the container wagon 21 with the container already positioned and the container prior to placement. FIG. 9 shows a container with the flaps 17 opened.

The container wagon 21 can be used with or without suspended discharge slides 22*b* in rail traffic. In particular, the container wagons 21 are used as a "discharge wagon" for loaded containers.

Figure 10:
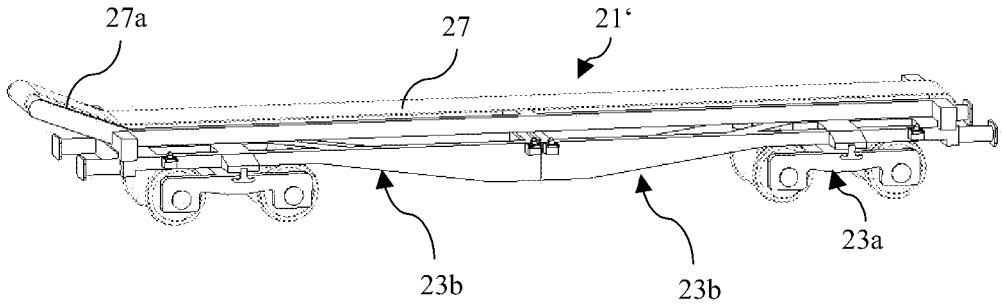
FIG. 10 to FIG. 12 are views of a container wagon with a conveyor belt system for unloading containers, FIG. 13
Figure 11:
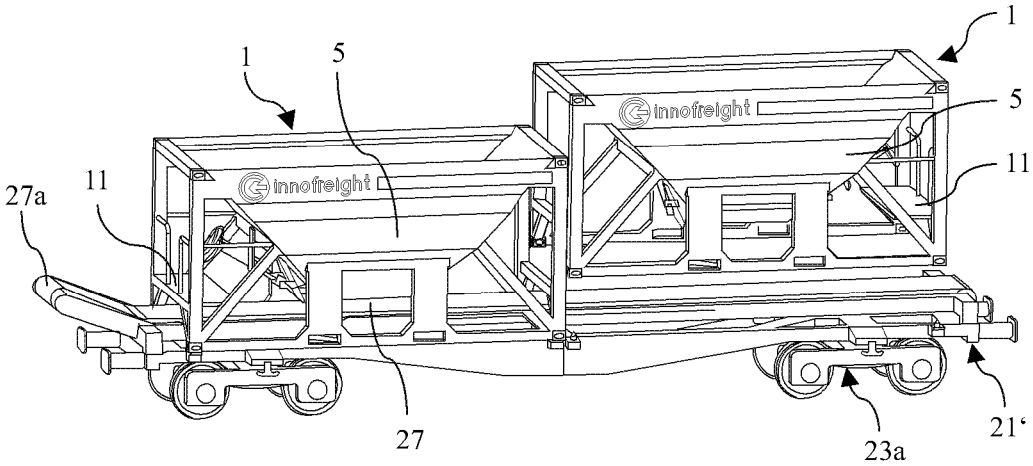
Figure 12:
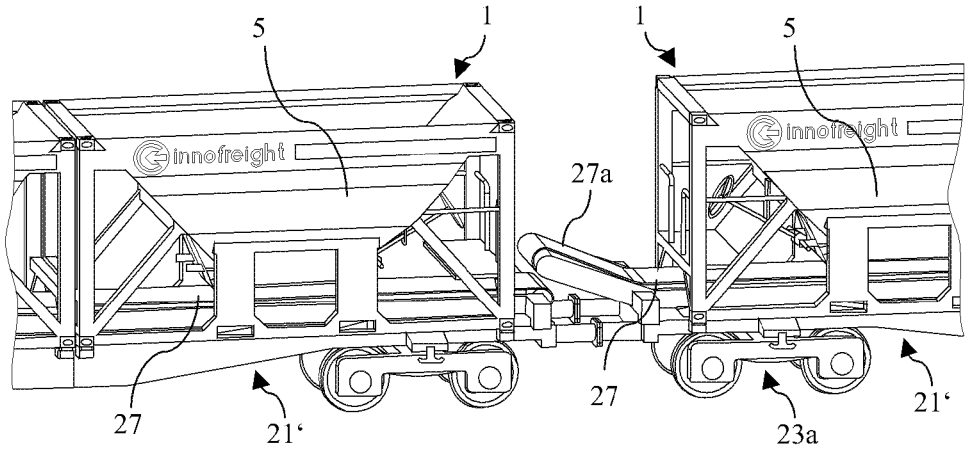

FIG. 10 to FIG. 12 show a container wagon 21', connecting elements 26 for the corner fittings 10 of the containers, and a conveyor belt 27 mounted to the wagon frame 23*b*. At least one of the end regions of conveyor belt 27 exhibits a conveyor belt section 27*a* that protrudes at a small, acute angle over the container wagon 21', and can be upwardly folded. As depicted on FIG. 12, this design makes it possible to continue transporting bulk material situated on the conveyor belt 27 of a wagon 21 on the conveyor belt 27 of a second, coupled container wagon 21'. In this way, unloaded bulk material can be transported from one wagon 21' to the next, so as to in this way supply gravel from any number of containers desired to a machine for track construction, for example. FIG. 10 shows the container wagon 21' without a container, while FIG. 11 shows it with a container already positioned on the connecting elements 26, and a container shortly before being placed on the wagon frame 23*b*. Corresponding drives are provided for the conveyor belts 27.

The transfer section can be replaced by a separate conveyor belt with its own drive.

Figure 13:
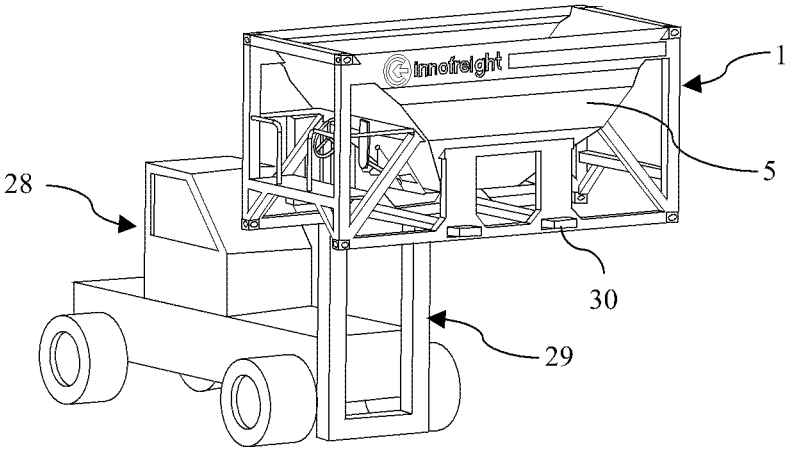
Figure 14:
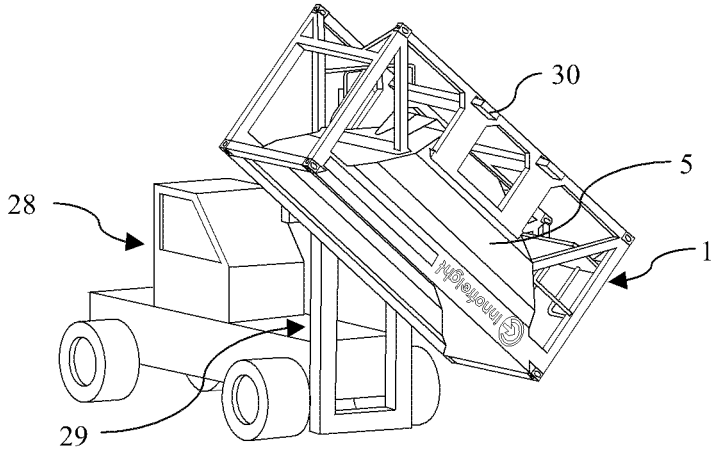
FIG. 14 is a forklift for the rotational unloading of a container.

For example, in combined truck/rail traffic, the containers can be reloaded with a forklift, wherein a correspondingly designed forklift can additionally permit a rotational unloading of the container, ad depicted on FIGS. 13 and 14. The forklift 28 is equipped with a lift frame 29, which carries a rotational device (not shown). When the forks 30 are lowered, the container is picked up, lifted, rotated into an "overhead position", and thereby emptied.

Figure 15:
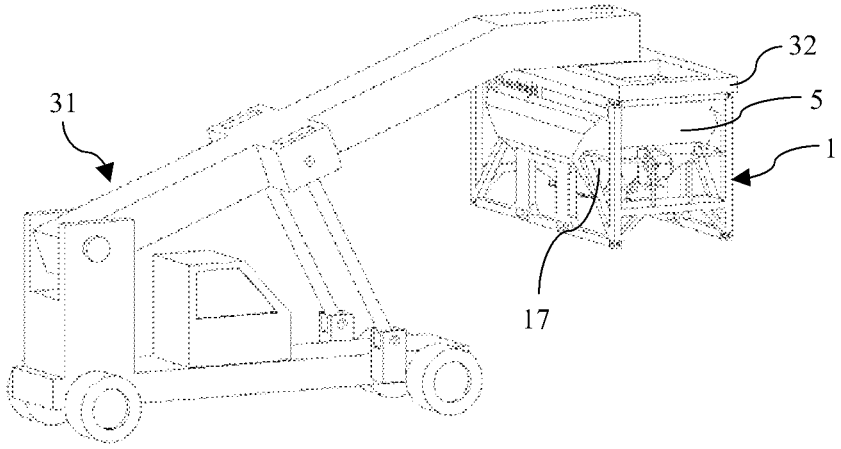
FIG. 15 is a reach stacker with incorporated container, and FIG. 16 to FIG. 19 is a truck with the container incorporated, and while unloading the container.

In addition, containers designed according to the invention can be reloaded and unloaded by means of a reach stacker. FIG. 15 shows a container gripped by a reach stacker 31. The upper corner fittings 10' of the container make it possible to grip the container with the support frame 32 of the reach stacker 31. For example, the container picked up by the reach stacker 31 can be emptied by opening the flaps 17, e.g., on a tipper truck or on the floor.

Figure 16:
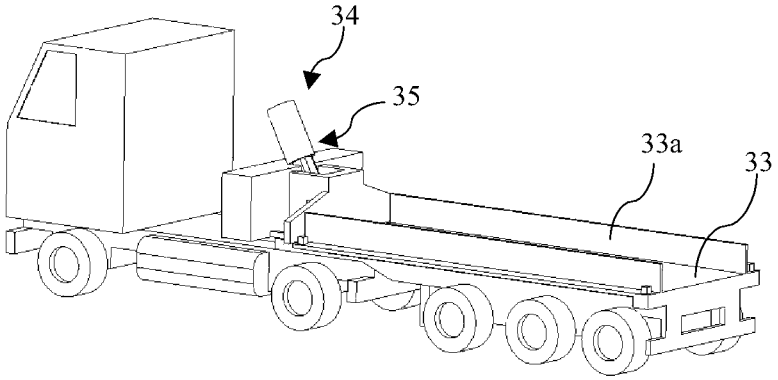
Figure 17:
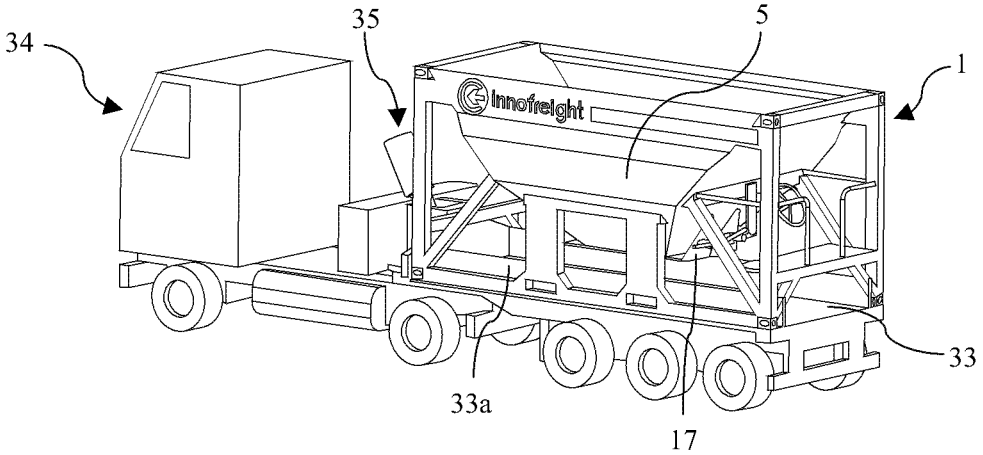
Figure 18:
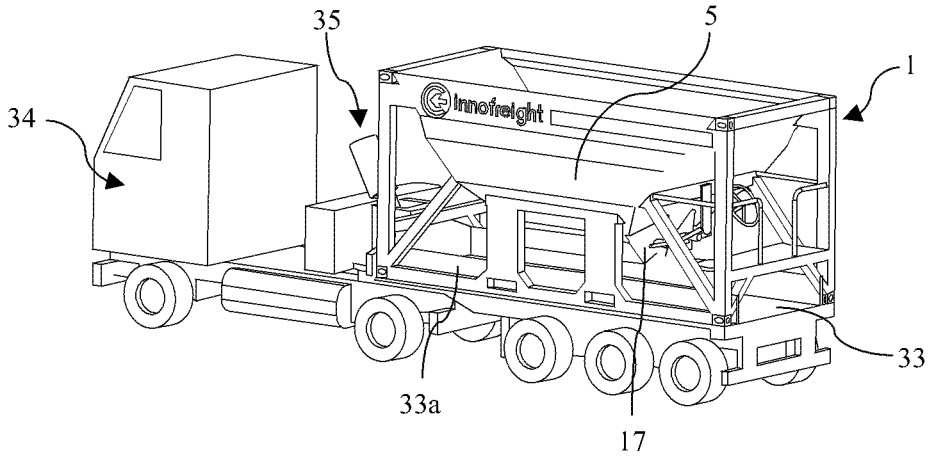
Figure 19:
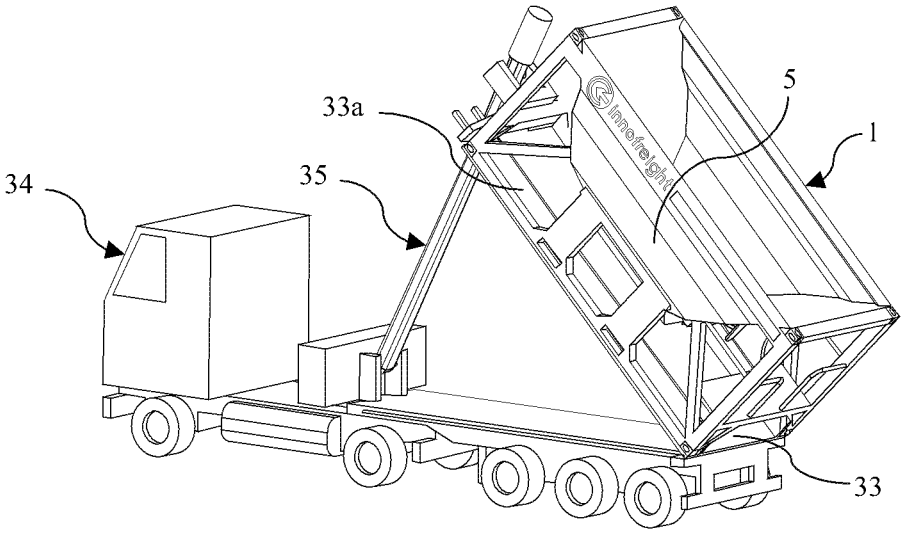

FIG. 16 to FIG. 19 show the transport and unloading of a container according to the invention on a truck. FIG. 16 depicts a truck 34 (semitrailer), whose platform 33 is laterally and longitudinally provided with tail lifts 33*a*. The truck 34 is equipped with a conventional tipping device 35 for the platform 33. FIG. 16 shows the truck 34 without a container, FIG. 17 with a positioned container. The tail lifts 33*a* are located in the tunnel-like free space of the container. FIG. 18 shows the container with opened flaps 17, so that the cargo drops onto the platform 33. The platform 33 is now tilted up (FIG. 19), so that the cargo slides from the platform onto the floor.

Although the apparatus is described as being made of steel, other known materials may of course be used.

Although particular embodiments have been described, many other variations and modifications and other uses will become apparent to those skilled in the art. Therefore, the present invention is not limited by the specific disclosure herein.

REFERENCE LIST

1 . . . Steel frame structure
2 . . . Lower longitudinal member
2' . . . Upper longitudinal member
3 . . . Corner support
4 . . . Cross member
4*a* . . . Brace
4*b* . . . Diagonal brace
4*c* . . . Brace
5 . . . Hopper
5*a* . . . Front wall
5*b* . . . Longitudinal wall
6 . . . Cross member
7 . . . Support frame
7*a* . . . Support element
8 . . . Support element
10 . . . Corner fitting
10' . . . Corner fitting
11 . . . Platform
12 . . . Outlet opening
12*a* . . . Opening half
14 . . . Separating element
15 . . . Opening
16 . . . Railing
17 . . . Flap
17*a* . . . Floor
17*b* . . . Side part
18 . . . Spindle drive
20 . . . Hand wheel
22 . . . Discharge chute
22*a* . . . Discharge funnel
22*b* . . . Discharge slide
23*a* . . . Rail mounting
23*b* . . . Wagon frame
23*c* . . . Retention opening
24 . . . Rotary slide
25 . . . Flap
26 . . . Connecting element
27 . . . Conveyor belt
27*a* . . . Upward folding section
28 . . . Forklift
29 . . . Lift frame
30 . . . Forks
31 . . . Reach stacker
32 . . . Support frame
33 . . . Platform
33*a* . . . Tail lift
34 . . . Truck
35 . . . Tipping device

The invention claimed is:

1. A container for transporting bulk material comprising:

a rectangular outer structure having an open frame, which carries at least one hopper for holding the bulk material that tapers and has an outlet opening with at least one floor flap, the frame having two lower longitudinal members defining a contact area, said contact area being free of connecting cross members between said two lower longitudinal members, so that inside the frame and beneath the hopper a downwardly completely open space is available, continuously extending in the longitudinal direction of the frame.

2. The container according to claim 1, characterized in that its contact area is formed exclusively by the two lower longitudinal members of the frame.

3. The container according to claim 1, characterized in that fittings are arranged on the frame, which are arranged for standard transport on rail vehicles and trucks.

4. The container according to claim 3, wherein said fittings are arranged on corners of the frame.

5. The container according to claim 3, wherein said rail vehicles are container wagons.

6. The container according to claim 1, characterized in that the lower longitudinal members are provided with corresponding pairs of openings for threading the forks of a forklift.

7. The container according to claim 1, wherein each longitudinal side of the frame has a respective pair of corner supports extending upward perpendicular to the corresponding lower longitudinal member, said corner supports being joined with cross members spaced a distance above the lower longitudinal members.

8. The container according to claim 7, characterized in that the frame has support elements, which support the hopper against the lower longitudinal members.

9. The container according to claim 1, characterized in that the outlet opening in the hopper for holding the bulk material has two of said floor flaps, which can be operated from a platform carried by the frame.

10. A container wagon for containers according to claim 1, comprising:

a wagon frame arranged on rail mountings for accommodating containers, a retention opening for inserting a discharge chute formed between the rail mountings for each container, a fill opening tailored to the outlet opening in the container receptacle, and connecting elements on the wagon frame for positioning the containers.

11. The container wagon according to claim 10, characterized in that the discharge chute has a discharge funnel and at least one discharge slide.

12. The container wagon according to claim 11, characterized in that the discharge chute has two discharge slides and, a flap is pivoted to the discharge chute, which can be operated from outside the discharge chute and moved into positions in which one or the other discharge slide is sealed.

13. A container wagon for containers according to claim 1, comprising:

a wagon frame arranged on rail mountings for accommodating containers, at least one conveyor belt mounted on the wagon frame, running over the length of the wagon, and connecting elements for positioning the containers on the wagon frame.

14. The container wagon according to claim 13, characterized in that at least one of the ends of the conveyor belt has an upward folding conveyor belt section protruding over the container wagon.

15. The container according to claim 1, characterized in that fittings are arranged on the frame, which are arranged for gripping by a reach stackers.

16. The container according to claim 1, characterized in that the frame has support elements, which support the hopper against lower corners of the frame.

17. The container according to claim 1, characterized in that the frame has support elements, which support the cross members against the lower longitudinal members.

* * * * *